US005537787A

United States Patent [19]

Abraham

[11] Patent Number: 5,537,787

[45] Date of Patent: Jul. 23, 1996

[54] PORTABLE SMOKING BOOTH

[75] Inventor: Dennis Abraham, 1738 Mosher Ave., Owatonna, Minn. 55060

[73] Assignee: Dennis Abraham

[21] Appl. No.: 558,197

[22] Filed: Nov. 13, 1995

[51] Int. Cl.[6] ..... E04H 1/00

[52] U.S. Cl. ..... 52/79.1; 52/36.4; 454/230

[58] Field of Search ..... 52/79.1, 27, 63, 52/79.4, 36.1, 36.2, 36.4; 454/230, 233, 341; 55/210, 274

[56] References Cited

U.S. PATENT DOCUMENTS 3,445,969 9/1966 Sherron ..... 52/28
3,571,988 3/1971 Nawman ..... 52/27
4,432,170 2/1984 Hewell ..... 52/28
5,085,134 2/1992 Hofstra et al. .
5,322,473 6/1994 Hofstra et al. ..... 454/230 X
5,472,466 12/1995 Oler .

*Primary Examiner*—Carl D. Friedman
*Assistant Examiner*—Creighton Smith
*Attorney, Agent, or Firm*—Kinney & Lange

[57] ABSTRACT

A portable smoking booth includes an enclosure secured to a base that defines a smoking area. A smoke detector is positioned to detect smoke within the smoking area. An air purifying mechanism purifies air within the enclosure. A control mechanism for accepting payment from a user within the smoking area controls the smoke detector such that when payment is made, the smoke detector is disabled.

13 Claims, 2 Drawing Sheets

50
44
16
46
19
10
2
14
21
18
51
24
20
22
49
48
53
12
2

PORTABLE SMOKING BOOTH

BACKGROUND OF THE INVENTION

The present invention relates to smoking booths, and in particular, it relates to a self-contained portable smoking booth for use in public areas.

In recent years, areas or places in which smoking is permitted have decreased dramatically. Designated areas have been established for cigarette smoking in restaurants, while pipe and cigar smoking have been prohibited. Smoking is prohibited in many commercial and public buildings including both federal and state government buildings. Smoking has been prohibited in train terminals, airport concourses, indoor sports arenas and outdoor sports arenas. Smoking has also been eliminated on most airplane flights, even long distance international flights.

Although, the number of smokers has decreased dramatically, smoking has not been eliminated. Persons who desire to smoke must leave a public or commercial building, railroad terminal or airport concourse to smoke. One solution to accommodate those who smoke has been to designate smoking rooms in which air purifiers have been installed. However, the establishment of designated smoking rooms is expensive. Such rooms, especially in commercial buildings, are costly since these rooms occupy valuable space that could be used for revenue producing purposes. In sports arenas, railroad terminals or airport concourses, dedicated smoking rooms are also not practical due to the high cost of space-in such areas. Furthermore, such rooms once used by smokers are not suitable for use by nonsmokers for other purposes since the smoking smell remains.

SUMMARY OF THE INVENTION

The present invention includes a portable smoking booth having an enclosure secured to a base. The enclosure with base define a smoking area. The enclosure includes a door for entry into the smoking area, and a smoke detector and an air purifier. A control mechanism for accepting payment from a user within the smoking area controls the smoke detector such that when payment is made, the smoke detector is disabled.

DETAILED DESCRIPTION OF THE PREFERRED EMBODIMENTS

Figure 1:
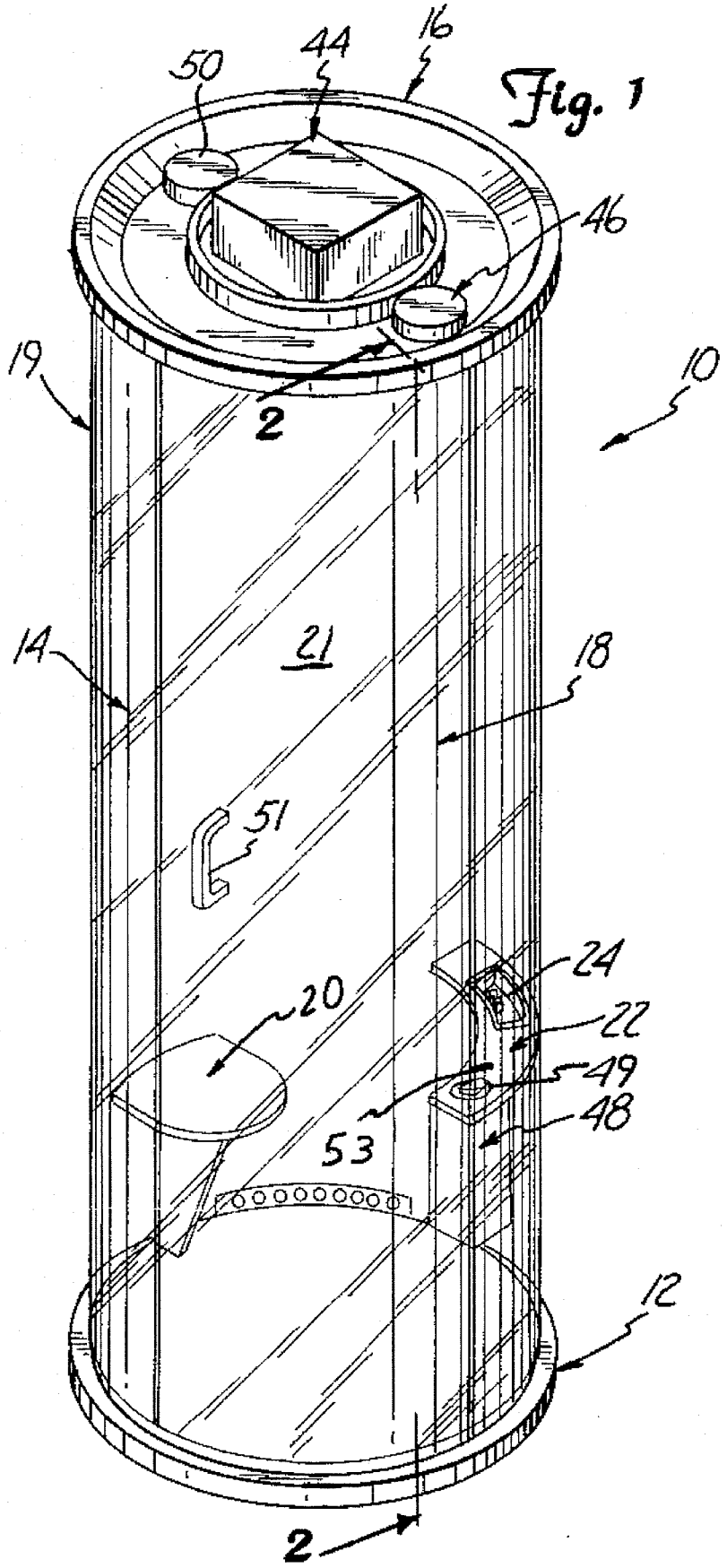
FIG. 1 is a prospective view of the present invention.

A smoking booth of the present invention is generally indicated at 10 in FIG. 1. The smoking booth 10 protects the non-smoking public from second-hand smoke while providing a smoker (not shown) a convenient area to smoke. The booth includes an enclosure 19 preferably made of a base 12, a wall 14 secured to the base 12, and a roof or top 16 that is secured to an upper portion of the wall 14. A door 18 with handle 51 provides an entry into the enclosure 19. The enclosure 19 defines a smoking area 21 in which a smoker may smoke. A seat 20 and a shelf 22 having an ashtray 24, preferably built within the shelf 22 are provided within the enclosure 19.

By portable enclosure is meant that the booth is movable from one location to another location as a unit without any need to disassemble the booth. The booth 10 of the present invention can be moved and positioned as a unit in public or commercial buildings, railroad terminals, airport concourses or sporting arenas. The booth 10 is made of materials light enough so that conventional lift trucks may be used to move the booth. Alternatively, casters or other types of ground engaging wheels can be provided beneath the enclosure.

In a preferred embodiment, the wall 14 and the door 18 of the present invention in combination have a generally cylindrical configuration. The cylindrical configuration of the booth provides an aesthetically pleasing appearance. Preferably the wall 14 and the door 18 are made of a clear or translucent polymer such as polycarbonate sold by General Electric of Pittsfield, Mass. The wall and door thicknesses will range from approximately 0.25 inches to 0.50 inches. A wall and door made from a clear or translucent polymer enable a prospective user of the booth to easily determine from a long distance whether the booth is in use. In addition, the user within the booth may be able to view activity outside the booth. The ability to easily see train or flight schedule monitor screens may be necessary in a railroad terminal or airport concourse.

Figure 2:
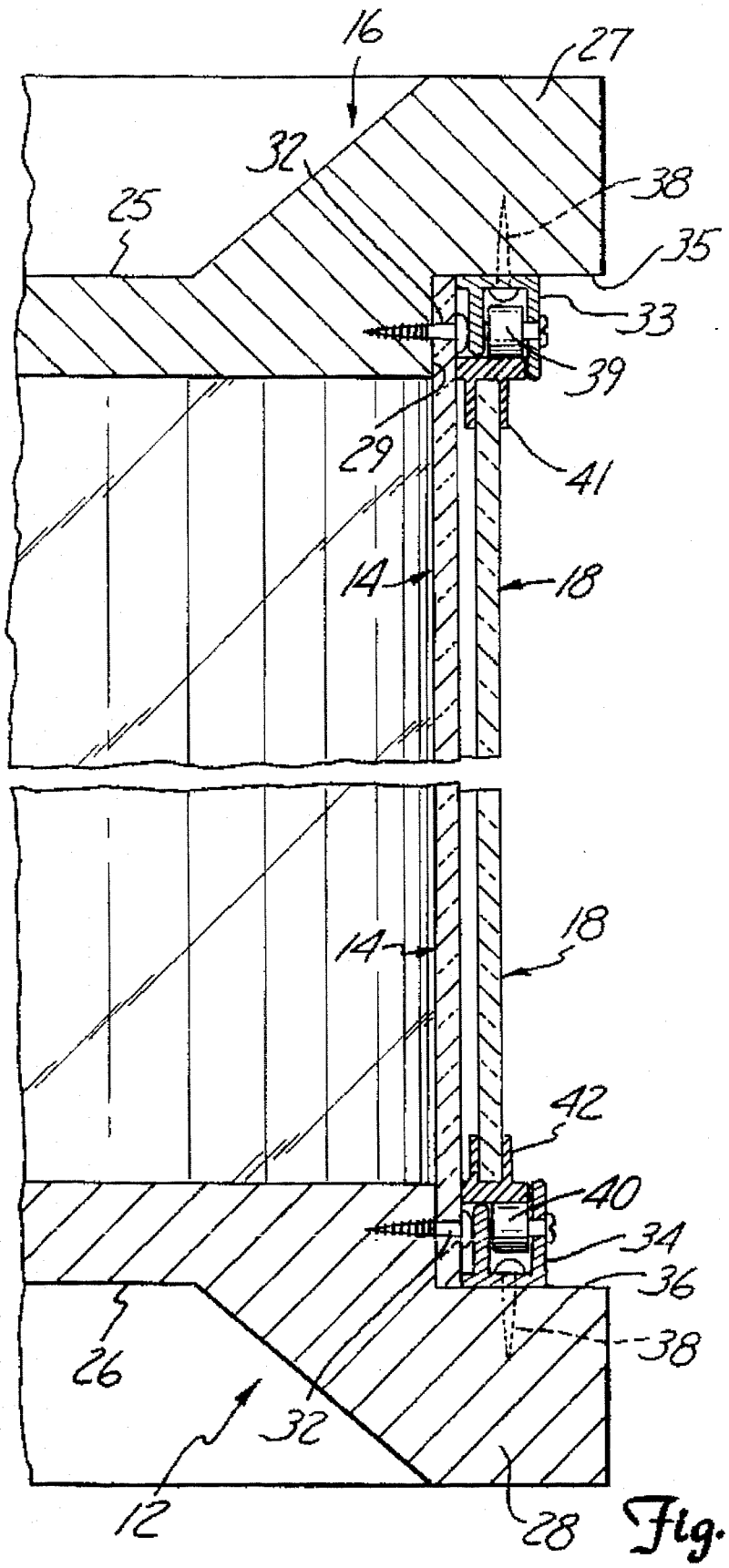
FIG. 2 is a cross-sectional view taken along the line 2—2 in FIG. 1.

The base 12 and the roof 16 of the booth are preferably identically configured in the form of a disc having a diameter corresponding substantially to the diameter of the cylindrically configured enclosure 19. The base 12 and the roof 16 are preferably made of an injection molded synthetic polymer. The roof 16 and the base 12, each have a central section 25 and 26 and a peripheral section 27 and 28, respectively, as best illustrated in FIG. 2. The peripheral sections 27 and 28 include outer recessed surfaces 29 and 30 against which the wall 14 is secured by suitable fasteners such as screws 32. The door 18 is slidably secured within tipper and lower door tracks 33 and 34, respectively. The door tracks 33 and 34 are secured to shoulders 35 and 36 in the base 12 and the roof 16, respectively. Such door tracks are well known and are typically made of an extruded material such as aluminum and are secured to the base 12 and the roof 16 by screws 32 and 38. The door tracks 33 and 34 include roller bearings 39 and 40, respectively, upon which the door 18 slides. The door 18 is secured within a door extrusion 41 and 42 that is secured to the door at upper and lower edges thereof, respectively, for slidably engaging the bearings 39 and 40, respectively.

Preferably mounted on top of the roof 16 is an air purifier system 44. Such purifier systems 44 are well known and are generally electrostatic type air purifiers. The purifier system 44 treats the air within the enclosure 19 removing smoke particles therefrom and returning air back within the enclosure 19. Alternatively, the purifier system draws air from the enclosure 19, removes smoke particles therefrom and exhausts the air outside of the enclosure 19. Make-up air is drawn within the enclosure by openings 23 in the wall as illustrated in FIG. 1 or in the base 12 or in both the wall and the base.

A smoke detector 46 is positioned on top of the roof 16 and is in air communication with the enclosure 19 such that the detector 46 detects the presence of smoke within the enclosure 19.

A control mechanism 48 is provided within the enclosure, and is preferably attached to the wall 14 such that the mechanism is accessible to a user within the enclosure 19. The control mechanism 48 accepts a payment, either coin, paper currency or credit card from the user within the enclosure 19. When the user makes a payment such as in coin slot 53, and the payment is accepted by the control mechanism 48, the smoke detector 46 is disabled such that once the user starts to smoke within the enclosure 19, the smoke detector—s alarm does not function.

The control mechanism also includes a timer 49. The timer 49 counts a selected time period such as 3 minutes. Once payment is made and accepted, the timer starts counting and the smoker's use of the booth to smoke a cigarette is limited to the timed period. The timer also preferably turns on the air purifier. Once the time period has expired, the smoke detector is disabled and the air purifier is turned off.

Alternatively, if payment is not accepted by the control mechanism 48, the smoke detector 46 is not disabled and stays on. Therefore, a smoker who does not pay to use the booth of the present invention will set off the smoke alarm function of the smoke detector 46 which will indicate to others and to the smoker that payment has not been made.

Preferably the control mechanism 48 is part of the shelf 22. The seat 20 is located preferably on a side opposite from the control mechanism 48 and the shelf 22 and the ashtray 24 so that the location of the central mechanism and ashtray is convenient for the smoker, and to minimize the amount of area needed within the enclosure 19. The ashtray 24 also preferably has a smoke filter associated therewith to reduce the contaminants that the air purifier needs to remove and to reduce the amount of second-hand smoke inhaled by the smoker.

A light fixture 50 is also included so that the enclosure 19 is illuminated. The fixture 50 can be any type of conventional fixture which includes a fluorescent, incandescent, neon or halogen light for providing light within the enclosure 19. The light 50 is preferably operable through the control mechanism 48. Once payment is made and accepted, the control mechanism 48 switches on the light and through the timer 49 switches the light off. Alternatively, the light may be turned on and off through a conventional light switch or a micro-switch (not shown) that is operably connected to the door 18.

The control mechanism 48, the smoke detector 46, the air purifier 44 and the light fixture 50 are supplied power from a 110 volt electrical power source. Therefore, the booth 10 of the present invention needs no special power requirements and can be plugged into a conventional 110 volt electrical outlet.

Although the present invention has been described with reference to preferred embodiments, workers skilled in the art will recognize that changes may be made in form and detail without departing from the spirit and scope of the invention.

What is claimed is:

1. A portable smoking booth comprising:

a base movable for over ground travel;

an enclosure secured to the base defining a smoking area, the enclosure having a door for entry within the smoking area;

a smoke detector for detecting smoke within the smoking area;

an air purifier for purifying air within the smoking area; and a control mechanism for accepting payment from a user within the smoking area and for controlling the smoke detector such that when payment is made, the smoke detector is disabled.

2. The booth of claim 1 and further including a seat disposed within the enclosure.

3. The booth claim 1 and further including an ashtray disposed within the enclosure.

4. The booth of claim 1 wherein the enclosure includes a cylindrical wall and an arcuate door generally conforming to the cylindrical wall and a roof secured to a top of the cylindrical wall.

5. The booth of claim 4 wherein at least a portion of the cylindrical wall is transparent.

6. The booth of claim 1 and further including a light within the smoking area.

7. The booth of claim 1 wherein the control mechanism includes a timer that disables the smoke detector for a selected period of time.

8. A smoking booth comprising:

an enclosure having a floor, wall and ceiling defining a smoking area;

an entry way for ingress and egress within the enclosure and having a mechanism for sealing the smoking area;

an air purifier in air communication with the smoking area for purifying air within the smoking area;

a smoke detector for detecting smoke within the smoking area; and a control mechanism for accepting payment from a user within the smoking area and for controlling the smoke detector such that when payment is made, the smoke detector is disabled.

9. The smoking booth of claim 8 wherein the control mechanism includes a timer that disables the smoke detector for a selected period of time.

10. The smoking booth of claim 8 and further including a seat disposed within the enclosure.

11. The smoking booth of claim 8 and further including an ashtray disposed within the enclosure.

12. The booth of claim 8 wherein at least a portion of the wall is transparent.

13. The booth of claim 8 and further including a light within the enclosure.

* * * * *

UNITED STATES PATENT AND TRADEMARK OFFICE

CERTIFICATE OF CORRECTION

PATENT NO. : 5,537,787

DATED : JULY 23, 1996

INVENTOR(S) : DENNIS ABRAHAM

It is certified that error appears in the above-indentified patent and that said Letters Patent is hereby corrected as shown below:

Col. 1, line 31, delete "space-in", insert --space in--

Col. 2, line 35, delete "tipper", insert --upper--

Col. 3, line 5, delete "detector--s", insert --detector's--

Signed and Sealed this

Twenty-sixth Day of November 1996

*Attest:*

Bruce Lehman

BRUCE LEHMAN

*Attesting Officer*

*Commissioner of Patents and Trademarks*